US005729822A

United States Patent [19]

Shivanath et al.

[11] Patent Number: 5,729,822

[45] Date of Patent: Mar. 17, 1998

[54] GEARS

[75] Inventors: Rohith Shivanath; Peter Jones, both of Toronto, Canada

[73] Assignee: Stackpole Limited, Mississauga, Canada

[21] Appl. No.: 653,044

[22] Filed: May 24, 1996

[51] Int. Cl.[6] ..... B22F 5/08

[52] U.S. Cl. ..... 428/551; 428/552; 419/28; 419/29; 148/225; 148/206

[58] Field of Search ..... 75/249, 950; 419/28, 419/29; 148/206, 225; 428/551, 552

[56] References Cited

U.S. PATENT DOCUMENTS

| | | | |
|---|---|---|---|
| 3,661,656 | 5/1972 | Jarleborg | 148/12.1 |
| 4,006,016 | 2/1977 | Zambrow et al. | 75/221 |
| 4,165,243 | 8/1979 | Sarnes et al. | 148/16.5 |
| 4,708,912 | 11/1987 | Huppmann | 428/547 |
| 5,201,966 | 4/1993 | Hirai | 148/514 |
| 5,308,702 | 5/1994 | Furukimi et al. | 428/403 |
| 5,476,632 | 12/1995 | Shivanath | 419/57 |

FOREIGN PATENT DOCUMENTS 2250227 8/1994 United Kingdom .

*Primary Examiner*—Ngoclan Mai
*Attorney, Agent, or Firm*—Eugene J. A. Gierczak

[57] ABSTRACT

A powder metal gear wheel having a core density of at least 7.3 g/cc, and in one embodiment 7.4 to 7.6 g/cc and a hardened carburized surface. A method of manufacturing transmission gears comprises, sintering a powder metal blank to produce a core density of between 7.4 to 7.6 g/cc, rolling the surface of the gear blank to densify the surface, and then heating the rolled sintered part and carburizing in a vacuum furnace.

7 Claims, 3 Drawing Sheets

GEARS

FIELD OF INVENTION

This invention relates to gear wheels formed from sintered powder metal blanks and methods for their production, and particularly relates to powder metal transmission gears having a core density greater than 7.3 g/cc, and preferably between 7.4 to 7.6 g/cc.

BACKGROUND OF THE INVENTION

Powder Metallurgy (PM) processes have successfully been utilized in producing metal parts because of the various advantages exhibited by PM processes which include:

1. the ability to form complex shapes in a single forming operation;
2. net or near net shaped capability resulting in minimal finish machining;
3. high volume capability;
4. the process is energy efficient; and
5. the process is cost competitive when considering other competing traditional processes.

Other competing traditional methods for manufacture include, for example, machining from forging, bar stock or tube. However, these traditional methods of manufacture have attendant poor material utilization and relatively high cost versus production by PM processes.

Notwithstanding the advantages referred to above, the utilization of PM sintered parts in automobiles is still relatively modest when compared to low alloy wrought steel. One area of future growth in the utilization of PM parts in the automotive industry resides in the successful entry of PM parts into more demanding applications, such as power transmission applications, for example, transmission gears. One problem with gear wheels formed by the PM process in the past has been that powder metal gears have reduced bending fatigue strength in the tooth and root region of the gear, and low wear resistance on the tooth flanks due to the residual porosity in the microstructure versus gears machined from bar stock, or forgings. One method of successfully producing PM transmission gears resides in rolling the gear profile to densify the surface as shown in U.K. patent GB 2,250,227B, 1994. However, this process teaches a core density which is below the densified regions which is typically at around 90% of full theoretical density of wrought steel. This results in a tooth with comparatively lower bending fatigue endurance than its machined wrought steel counterpart.

Although sintering temperature can have a significant influence on dynamic properties of a sintered PM part at a given density, the ultimate dynamic property levels attainable for any sintering regime is also controlled by the combination of alloying system used and sintered density attained. Although it is possible to obtain high tensile strength with typical PM processes (with or without heat treatment) at single pressed density levels of up to 7.2 g/cc, dynamic properties such as fracture toughness (ASTM test procedures E399-83) and fatigue endurance under cyclic loading will invariably be less than those of steel of comparable strength. Therefore, processes for the production of PM transmission gears have not gained wide support. This is primarily due to the negative effects of residual porosity. Accordingly, processes to improve properties of PM parts subjected to high loading must consider both core densification as well as surface densification for good cyclic bending endurance and surface endurance respectively.

It is an object of this invention to provide a PM transmission gear having both high surface endurance (i.e. high density of the surface) and tooth bending endurance. It is also an object of this invention to provide an improved method to produce PM transmission gears.

It is an aspect of this invention to provide a powder metal gear wheel having a core density of at least 7.3 g/cc, and in one embodiment between 7.4 to 7.6 g/cc and a hardened carburized surface.

It is a further aspect of this invention to provide a powder metal gear wheel wherein said surface has a density approaching the full density of wrought steel.

It is yet another aspect of this invention to provide a method of manufacturing a metal gear which comprises the steps of:

a) sintering a powder metal blank to produce a core density of between 7.4 to 7.6 g/cc;

b) rolling the surface of the gear blanks to densify the surface;

c) heating the rolled sintered part and carburizing in a vacuum furnace.

It is yet another aspect of this invention to provide a method wherein propane is utilized in said heat treatment step.

DRAWINGS

These and other objects and features of the invention shall now be described in relation to the drawings.

DESCRIPTION OF THE INVENTION

Powder Metals, Used

Figure 1:
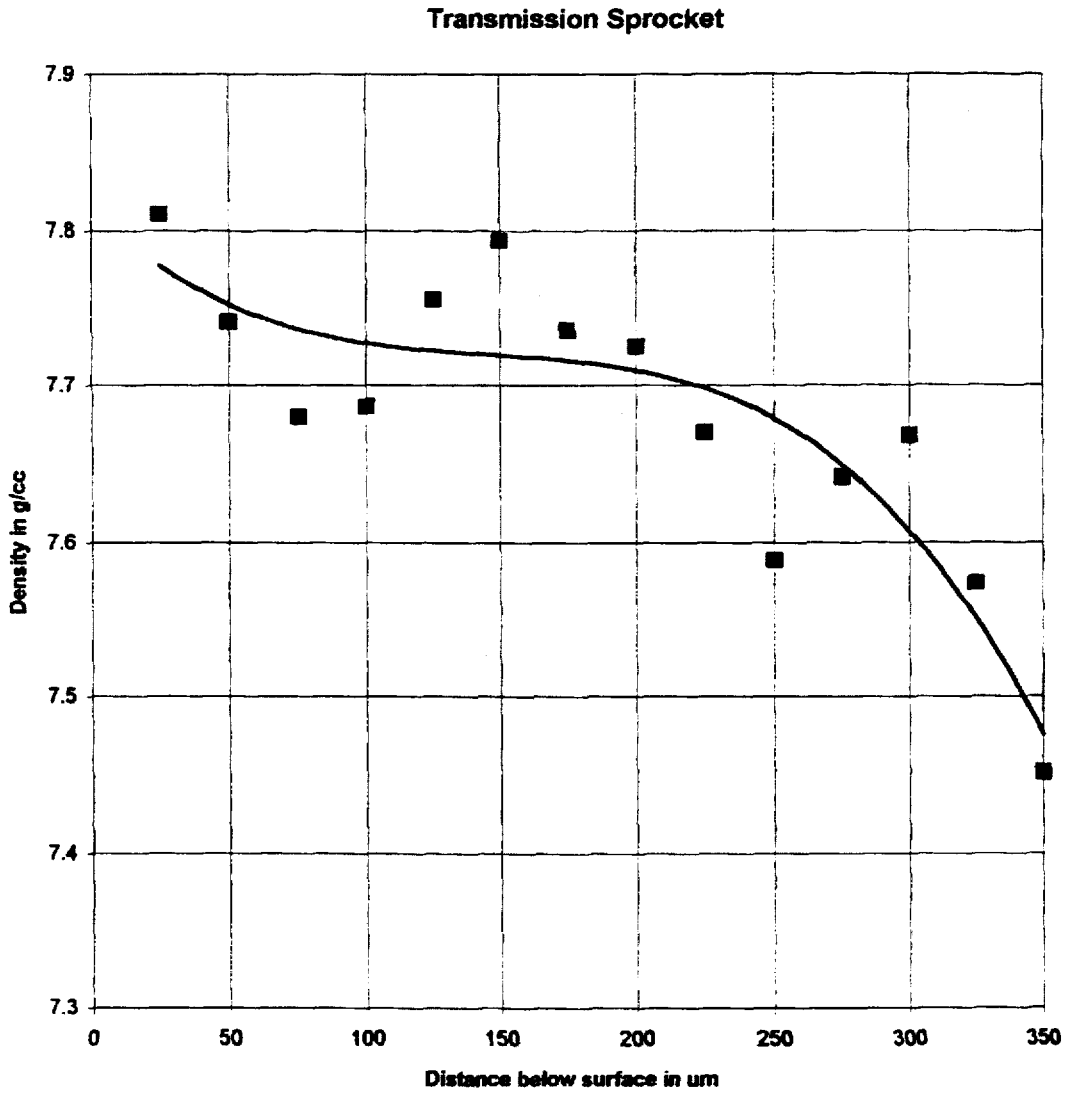
FIG. 1 is a density vs distance graph of a gear wheel with a transmission densified layer at the surface.

While traditional PM alloys are adequate for many applications, their technical and cost limitations become apparent when considering the manufacture and use of powder metal transmission gears. Although copper and nickel have typically been utilized in the past as alloying elements for ferrous materials, it is preferable to utilize manganese, chromium and molybdenum when developing hardenability of PM parts due to their higher cost effectiveness. Moreover, manganese is approximately four times more effective than nickel as a solid solution strengthener.

The combined effects of alloying with Cr, Mn and Mo, coupled with high temperature sintering on particular bond quality and pore morphology, powder metal components with significantly superior balance of mechanical properties may be achieved over conventional PM alloys and processing. Furthermore, by admixing these elements with atomized base iron powders, the advantages of maintaining high compressibility and minimizing material costs may be realized. In this invention, alloys of iron, such as manganese, chromium and molybdenum may be used and are added, as ferro alloys to the base iron powder as described in U.S. Pat. No. 5,476,632, which is incorporated hereby by reference. Carbon is also added. The alloying elements ferro manganese, ferro chromium, and ferro molybdenum may be used individually with the base iron powder, or in any combination, such as may be required to achieve the desired functional requirements of the manufactured article. In other words, two ferro alloys can be used or three ferro alloys can be blended with the base iron powder. Examples of such base iron powder includes Hoeganaes Ancorsteel 1000/1000B/1000C, Quebec Powder Metal sold under the trade marks QMP Atomet 1001. The base iron powder composition consists of commercially available substantially pure iron powder which preferably contains less than 1% by weight unavoidable impurities. Additions of alloying elements are made to achieve the desired properties of the final article. The particle size of the iron powder will have a distribution generally in the range of 10 to 350 μm. The particle size of the alloying additions will generally be within the range of 2 to 20 μm. To facilitate the compaction of the powder a lubricant is added to the powder blend. Such lubricants are used regularly in the powdered metal industry. Typical lubricants employed are regular commercially available grades of the type which include, zinc stearate, stearic acid or ethylene bistearamide. The formulated blend of powder containing iron powder, carbon, ferro alloys and lubricant will be compacted in the usual manufacturing manner by pressing in rigid dies in regular powdered metal compaction presses. Compacting pressures of around 40 tons per square inch are typically employed.

Alternatively, pre-alloyed powders may be used in accordance with the teachings of this invention.

In other words, base iron powders with additions of ferro alloys may be used or pre-alloy powders for example containing molybdenum may be used in accordance with this invention.

Temperature

When sintering the powder metals referred to above and particularly manganese and chromium, high temperature sintering at temperatures greater than 1250° C. is utilized. The combination of high temperature and low atmosphere dew points (−20° C. to −30° C.) and the presence of free carbon, will easily reduce oxides of manganese and chromium, to produce clean, homogenous sintered parts with very low oxygen contents of less than 150 parts per million.

Density

Moreover, as the density of PM material increases both physical and mechanical properties improve.

Core densities and particularly core densities of powder metal gear profiles of greater than 7.3 g/cc can be produced by a variety of means including:

1. warm pressing;
2. double press, double sintering;
3. high density forming as disclosed in a patent application filed by Stackpole Limited in the United States on May 15, 1996, which is adopted by reference herein
4. use of die wall lubrication, instead of admixed lubricants during powder compaction; and
5. rotary forming after sintering.

Sintered gear blanks which have a core density of a minimum of 7.3 g/cc and particularly between 7.4 to 7.6 g/cc exhibit significant increase in mechanical properties.

Roll Forming

Moreover gear rolling processes may be utilized to selectively densify the gear and sprocket teeth so as to enhance the following:

(a) tooth surface durability;

(b) tooth bending fatigue strength;

(c) gear precision.

The selective densification process as described in U.K. Patent G.B. 2,250,227B, 1994 may be utilized, which consists of densifying the outer surface of the gear teeth by a single die or twin die rolling machine and may include separate and or simultaneous root and flank rolling. In each case the rolling die is in the form of a mating gear made from hardened tool steel. In use the die is engaged with the sintered gear blank, and as the two are rotated their axis are brought together to compact and roll the selected areas of the gear blank surface.

In one embodiment the surface may be densified to greater than 7.7 g/cc. In other words, the surface of the gear blank is densified to greater than 98% of theoretical full density.

FIG. 1 shows a surface densified layer of a sintered gear tooth which reveals that the structure at the surface is approaching full theoretical density of wrought steel. The surface is comprised of fine high carbon tempered martensite with hardness greater than 60 HRC. Selective densification can occur by rolling the profile in highly stressed locations whether at the flank or root while the core density remains at approximately 7.4 to 7.6 g/cc.

Heat Treatment

The production of a transmission gear having a core density of approximately 7.4 to 7.6 g/cc with densified teeth is then subjected to heat treatment such as carburizing in a vacuum. The heat treatment may comprise of the utilization of a carburizing atmosphere which may consist of methane or propane where the carbon atoms will migrate from the methane or propane to the surface layers of the article. The heat treatment operation is generally carried out within the temperature range of 800° C. to 1300° C.

Discussion

If one utilizes a sintered gear blank having a core density of approximately 90% of theoretical (i.e. approximately 7.0 g/cc), the sintered structure is more porous than that of a part having a core density of approximately 7.4 to 7.6 g/cc. Accordingly, sintered gear blanks having core densities of approximately 90% of theoretical will tend to absorb more carbon from the carburizing heat treatment within core regions, causing the formation of embrittling carbide networks. Therefore by producing sintered gear blanks having core densities of approximately 7.4 to 7.6 g/cc, less carbon migrates to the core while more carbon tends to concentrate at the surface. The concentration of carbon at the surface produces a hard surface with high endurance which is well suited in the utilization as transmission gears while cores having densities of approximately 7.4 to 7.6 g/cc have increased ductility relative a core having 90% of full theoretical density (i.e. 7.0 g/cc). The increased ductility results from the relatively higher density of the core at approximately 7.4 to 7.6 g/cc, and as well because of the lower carbon levels. A higher core density will tend to result in a transmission gear having greater toughness. Therefore, superior properties are obtained because of two effects: firstly, high core density in itself is beneficial to mechanical properties; secondly, the higher density results in less core carbon and formation of embrittling carbides is prevented. The more carbon that migrates towards the core, the more brittle the core becomes.

It has been found that improved tooth bending endurance is achieved when producing a powder metal gear wheel having an intermediate density at the core. In particular, an intermediate density of approximately 7.4 to 7.6 g/cc at the core exhibits the following features:

1. Improved Crack Propagation Characteristics

Figure 2:
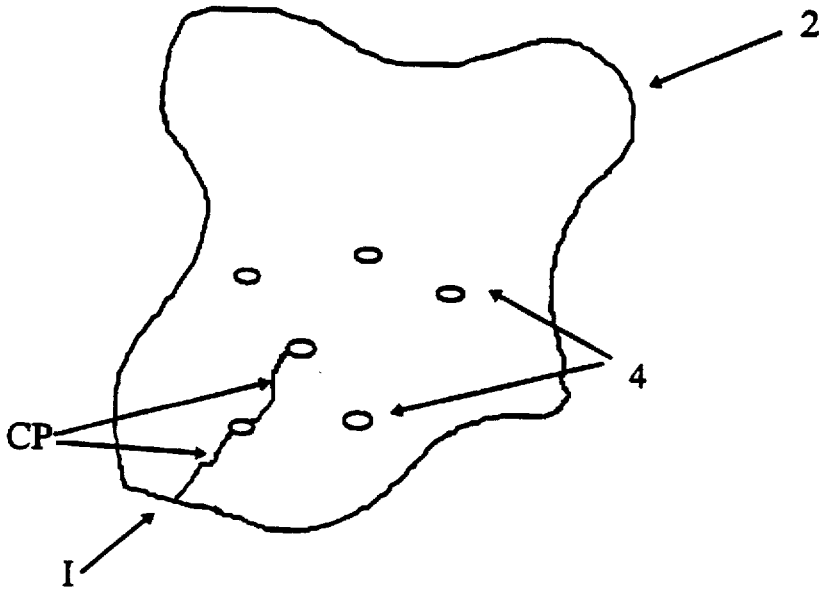
FIG. 2 is a representative view of a portion of a micrograph of a sintered powder metal part.

FIG. 2 is a representative view of a portion of a micrograph of a sintered powder metal part 2. A crack propagation is test conducted in accordance with ASTM test procedures E399-83 by inducing a crack 1 to the sintered powder metal part 2. The sintered powder metal part 2 presents a plurality of pores 4. The number of pores 4 per volume varies with the density of the sintered powder metal part.

Figure 3:
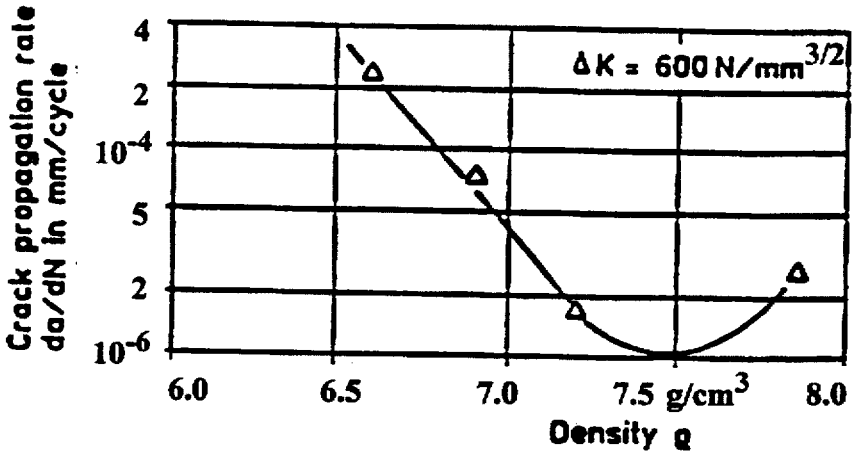
FIG. 3 is a propagation rate vs density.

The crack propagation CP is minimized when the sintered powder metal part has a density in the range of approximately 7.4 to 7.6 g/cc. FIG. 3 illustrates that the crack propagation rate is minimized in the vicinity between 7.4 to 7.6 g/cc. The crack propagation rate increases at densities less than 7.4 g/cc and more than 7.6 g/cc. Such test have been conducted by F. J. Esper and C. M. Sonsino in an article published by the European Powder Metallurgy Association (EPMA) entitled "Fatigue Design for PM Components" on an Fe 1.5% to 0.5% carbon sintered powder metal part. However, such work studied the uniform density of a homogeneous part and did not distinguish between core and surface densities.

One speculates that the pore size is optimized in the density range between 7.4 to 7.6 g/cc, to resist cracking. In other words, the crack propagation CP tends to stop at the pores 4. The crack propagation rate of sintered powder metal parts having densities approaching full theoretical densities is much higher than at the densities between 7.4 to 7.6 g/cc.

2. Noise Characteristics

The noise produced by intermediary gears is dampened by the pores or porosity of the sintered powder metal gear wheels when compared with gears produced from wrought steel.

3. Lighter

Parts including sintered powder metal transmission gears made by the invention described herein are lighter than the same parts made from wrought steel having densities of 7.8 g/cc.

4. Less Expensive Process

Sintered powder metal transmission gears made in accordance with the invention described herein are generally less expensive to produce than parts made from wrought steel.

5. Complex Stages

Sintered powder metal parts including sintered powder metal transmission gears can be pressed to complex shapes that can not be economically machined by traditional methods.

Accordingly, by utilizing the invention herein one produces a transmission gear having a hard durable surface and tough core which maximizes the bending endurance of the transmission gear. Accordingly, a tough fracture-resistant core is produced in accordance with the invention described herein.

Figure 4:
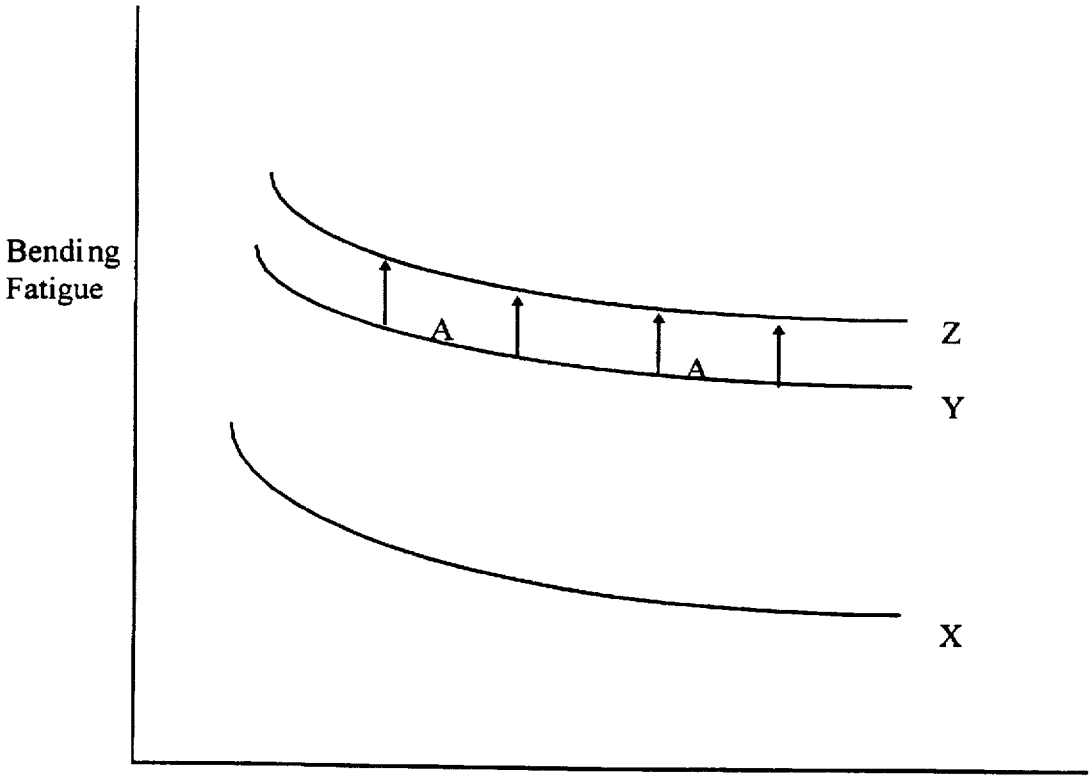
FIG. 4 shows the bending fatigue strength of the invention disclosed versus regular PM and wrought steel.

FIG. 4 illustrates the advantages of the invention disclosed herein. In particular, FIG. 4 shows the fatigue strength of regular sintered powder metal parts marked by curve X. Curve Y illustrates the improved bending fatigue strength exhibited by sintered powder metal gears which have be selectively densified in accordance with the teachings of U.K. Patent G.B. 2,250,227B, 1994, where core densities are typically at 7.0 g/cc. Curve Z illustrates the bending fatigue strength of wrought steel at a density of 7.8 g/cc. By utilizing the invention described herein the bending fatigue strength of a sintered powder metal part approaches that of wrought steel as shown by the arrows A. Accordingly, the invention described herein is well suited for the production of transmission gears.

Moreover, the amount of carbon in the core area may also be controlled and dictated by the starting powders that are utilized in the production therein.

Moreover, the amount of carbon in the core area may also be controlled and dictated by the starting powders that are utilized in the production therein.

Although the preferred embodiment as well as the operation and use have been specifically described in relation to the drawings, it should be understood that variations in the preferred embodiment could be achieved by a person skilled in the trade without departing from the spirit of the invention claimed herein.

The embodiments of the invention in which an exclusive property or privilege is claimed are defined as follows:

1. A powder metal gear wheel having a core density of at least 7.3 g/cc and a hardened carburized surface.

2. A powder metal gear wheel as claimed in claim 1 wherein said surface has a density approaching the full density of wrought steel.

3. A powder metal gear wheel as claimed in claim 2 having a core density of approximately 7.4 g/cc to 7.6 g/cc.

4. A method of manufacturing a powder metal gear which comprises the steps of a) sintering a powder metal gear to produce a core density of approximately between 7.4 to 7.6 g/cc;

b) rolling the surface of the sintered powder metal to densify the surface;

c) heating the rolled sintered gear and carburizing in a vacuum furnace.

5. A method as claimed in claim 4 wherein propane is utilized in said heat treatment step.

6. A method as claimed in claim 5 wherein said heating is conducted at a temperature between 800° C. and 1300° C.

7. A method as claimed in claim 6 wherein said sintering is conducted at a temperature greater than 1250° C.

* * * * *